US012497731B2

(12) United States Patent
Fang et al.

(10) Patent No.: US 12,497,731 B2
(45) Date of Patent: Dec. 16, 2025

(54) CONDUCTIVE FAR-INFRARED HEAT-GENERATING FIBER AND PREPARATION METHOD THEREFOR

(71) Applicant: SHANDONG HUANGHE DELTA INSTITUTE OF TEXTILE SCIENCE AND TECHNOLOGY CO., LTD., Shandong (CN)

(72) Inventors: Kuanjun Fang, Shandong (CN); Lei Fang, Shandong (CN); Lili Wu, Shandong (CN); Chunmiao Shen, Shandong (CN); Chenglu Liu, Shandong (CN); Zhenzhen Liu, Shandong (CN); Tao Li, Shandong (CN); Kai Lin, Shandong (CN); Yuexing Liu, Shandong (CN)

(73) Assignee: SHANDONG HUANGHE DELTA INSTITUTE OF TEXTILE SCIENCE AND TECHNOLOGY, Shandong (CN)

( * ) Notice: Subject to any disclaimer, the term of this patent is extended or adjusted under 35 U.S.C. 154(b) by 463 days.

(21) Appl. No.: 17/256,207

(22) PCT Filed: Dec. 7, 2018

(86) PCT No.: PCT/CN2018/119722

§ 371 (c)(1),
(2) Date: Dec. 27, 2020

(87) PCT Pub. No.: WO2020/015278

PCT Pub. Date: Jan. 23, 2020

(65) Prior Publication Data

US 2021/0262159 A1 Aug. 26, 2021

(30) Foreign Application Priority Data

Jul. 16, 2018 (CN) ..... 201810777364.9

(51) Int. Cl.

| | |
|---|---|
| ***D06M 11/51*** | (2006.01) |
| ***D06M 11/74*** | (2006.01) |
| *D06M 101/32* | (2006.01) |
| *D06M 101/34* | (2006.01) |

(52) U.S. Cl.
CPC ..... *D06M 11/51* (2013.01); *D06M 11/74* (2013.01); *D06M 2101/32* (2013.01); *D06M 2101/34* (2013.01)

(58) Field of Classification Search
CPC .. D06M 11/51; D06M 11/74; D06M 2101/32; D06M 2101/34; D06M 2101/06; D06M 2101/20; D06M 11/83; D06M 10/025; D06M 2101/22; D06M 2101/36; D06M 13/196; D06M 13/224; D06M 13/262; D06M 13/463; D06M 2101/30
USPC ..... 428/299.1; 442/110; 977/742
See application file for complete search history.

(56) References Cited

U.S. PATENT DOCUMENTS

| | | | | |
|---|---|---|---|---|
| 2011/0003153 A1* | 1/2011 | Chung | ..... | D06M 11/83 427/125 |
| 2011/0198543 A1* | 8/2011 | Tarumoto | ..... | C09C 1/56 252/511 |

FOREIGN PATENT DOCUMENTS

| | | | | | |
|---|---|---|---|---|---|
| CN | 101896014 | A | | 11/2010 | |
| CN | 104594077 | A | | 5/2015 | |
| CN | 105002735 | A | | 10/2015 | |
| CN | 205160810 | U | | 4/2016 | |
| CN | 106637913 | A | | 5/2017 | |
| CN | 106702722 | A | * | 5/2017 | ..... D06M 11/74 |
| CN | 106884315 | A | | 6/2017 | |
| CN | 107043564 | A | | 8/2017 | |
| CN | 107216826 | A | * | 9/2017 | ..... C09J 175/04 |
| CN | 107805938 | A | * | 3/2018 | ..... D06M 11/74 |
| CN | 107988789 | A | | 5/2018 | |
| JP | 2002249283 | A | * | 9/2002 | |
| KR | 2013038725 | A | * | 4/2013 | |
| KR | 2015102561 | A | * | 9/2015 | ..... D06M 11/74 |

OTHER PUBLICATIONS

English Abstract of CN patent (Year: 2017).*
International Search Report for PCT/CN2018/119722 mailed Apr. 17, 2019, ISA/CN.

* cited by examiner

*Primary Examiner* — Matthew D Matzek
(74) *Attorney, Agent, or Firm* — Yue (Robert) Xu; Apex Attorneys at Law, LLP

(57) ABSTRACT

A conductive far-infrared heat-generating fiber and a preparation method therefor. In the process of preparing the conductive far-infrared heat-generating fiber, the preparation method specifically comprises: A) pretreating a matrix fiber, and then drying same; B) impregnating, in a coating liquid of a conductive material, the matrix fiber obtained in step A, and then drying same; and performing step B) at least once, and obtaining the conductive far-infrared heat-generating fiber. The preparation method for the conductive far-infrared heat-generating fiber is simple and can realize good control of resistivity and heat generation.

1 Claim, No Drawings

CONDUCTIVE FAR-INFRARED HEAT-GENERATING FIBER AND PREPARATION METHOD THEREFOR

This application is the national phase of International Application No. PCT/CN2018/119722, titled "CONDUCTIVE FAR-INFRARED TEAT-GENERATING FIBER AND PREPARATION METHOD THEREFOR", filed on Dec. 7, 2018, which claims the priority to Chinese Patent Application No. 201810777364.9, titled "CONDUCTIVE FAR-INFRARED HEAT-GENERATING FIBER AND PREPARATION METHOD THEREFOR", filed on Jul. 16, 2018 with the China National Intellectual Property Administration, which is incorporated herein by reference in entirety.

FIELD

The present disclosure relates to the technical field of fiber materials, in particular, relates to a conductive far-infrared heat-generating fiber and preparation method therefor.

BACKGROUND

Conductive heat-generating fibers are essential materials for intelligent wearable electronic products, health care products and medical supplies. Currently, the conductive heat-generating fibers used in markets are mainly the products of metal wires and carbon fibers. However, such products have poor flexibility and elasticity, are difficult to weave, and are easily broken after being bended several times during use, which results in poor product reliability. Therefore, non-carbon fibers and metal conductive heat-generating fibers have become a research and development focus.

Chinese Patent with publication No. CN106637913A discloses a method for preparing conductive fibers, including firstly preparing a graphene derivative solution, then coating the graphene derivative solution on the surface of a selected polymer fiber to form a composite fiber, and then moving the composite fiber to pass a microwave heating zone at a set speed in a set atmosphere to heat the graphene derivative layers on the surfaces of the compound fiber for a short time, and finally cooling and extruding to obtain a graphene layer-coated conductive polymer fibers having a good conductive capacity.

Chinese Patent with Publication No. CN107988789A discloses a composite conductive fiber and a preparation method. The composite conductive fiber is prepared from the following components: a fiber substrate, Cu-0.5Zr alloyed powder, Al—Si alloyed powder and Zn liquid. The preparation method comprises the following steps: putting the fiber substrate into the $SO_2$ atmosphere and carrying out bleaching treatment for 20 to 25 minutes; then immersing the blenched fiber substrate into a cleaner and soaking for 10 to 15 minutes, washing the soaked fiber substrate with clear water and drying; putting the Cu-0.5Zr alloyed powder and the Al—Si alloyed powder into a reaction still, heating to 1700 to 1800° C. and melting the two substances into a liquid state; uniformly stirring and spraying a mixture to the surface of the fiber substrate by using an injection machine; immersing the fiber substrate into the Zn liquid and electroplating the fiber substrate for 25 to 30 seconds; taking out the fiber substrate and then centrifuging the fiber substrate a centrifugal machine for 20 to 25 minutes to obtain the composite conductive fiber.

Chinese Patent with Publication No. CN106884315A discloses conducting fiber of a composite structure and a preparation method thereof. The conducting fiber comprises a conducting fiber substrate and a conducting enhancing layer, wherein the conducting enhancing layer is coated on the outer surface of the conducting fiber substrate by using carbon nanometer tubes/graphene as a conducting agent; the conducting fiber substrate uses the conducting fiber with a carbon black conducting part on the surface; the conducting fiber substrate is manufactured by performing ultrasonic processing on coating liquid and soaking the conducting fiber substrate into the coating liquid at the same time so as to attach onto the surface of the conducting fiber substrate and to form the sufficient coating layer.

The conductive fibers provided by the patents discussed above have a long preparation process and high energy consumption. The key problem is that the electrical resistance and heat generation of the conductive fiber are difficult to control, thereby limiting the development of the conductive fiber.

SUMMARY

The technical problem solved by the present invention is to provide a method for preparing a conductive far-infrared heat-generating fiber. This method has a short process flow, and importantly it can achieve good control of electrical resistance and heat generation.

In view of this, the present application provides a method for preparing a conductive far-infrared heat-generating fiber, comprising the following steps:

A) pretreating a substrate fiber, and then drying; and

B) impregnating the substrate fiber obtained in step A) into a coating liquid of a conductive material, and then drying, wherein step B) is carried out at least once, to obtain a conductive far-infrared heat-generating fiber.

Preferably, the pretreatment is performed by treating the substrate fiber using pretreatment liquid and/or by pretreating the substrate fiber using plasma.

Preferably, the method further comprises curing the dried fiber after drying, or when step B) is carried out more than once, the method further comprises curing after step B) is repeated;

wherein the curing temperature is 100° C.-250° C., and the curing time is 30-3600 s.

Preferably, the coating liquid of the conductive material is one or more selected from conductive carbon black paste, conductive silver paste, conductive graphene paste, conductive copper paste, conductive aluminum paste, conductive gold paste, conductive carbon nanotube paste, conductive nickel paste and conductive graphite paste.

Preferably, the coating liquid of the conductive material further comprises 0.1 wt %-50 wt % of additive, wherein the additive is resin and curing agent, wherein the resin is one or more selected from epoxy resin, organic silicone resin, polyimide resin, phenolic resin, polyurethane resin, acrylic resin and unsaturated polyester resin, and the curing agent is one or more selected from curing agents of aliphatic amines, aromatic amines, amidoamines, latent curing amines, urea, polythiols and polyisocyanates.

Preferably, the pretreatment liquid comprises surfactant or oxidant, and the pretreatment liquid is in a concentration of 0.01 wt %-30 wt %; wherein the surfactant is one or more selected from anionic surfactant, nonionic surfactant, cationic surfactant and Gemini surfactant; and the oxidant is one or two selected from organic oxidant and inorganic oxidant.

Preferably, when the pretreatment is performed by treating the substrate fiber using pretreatment liquid, the pretreatment is specifically performed by:

placing the pretreatment liquid into a liquid tank, drawing out the substrate fiber from a fiber reel I, impregnating the substrate fiber across a guide eyelit into the pretreatment liquid using a guide roller, controlling the amount of the liquid applied on the substrate fiber using a milling roll or a slit, and then drying by a heating device and winding the substrate fiber around a fiber reel II.

Preferably, step C) is specifically performed by:

placing the coating liquid of the conductive material into a liquid tank, drawing out the substrate fiber wound around the fiber reel II, impregnating the substrate fiber across a guide eyelit into a coating liquid of a conductive material using a guide roller, controlling the liquid applied on the substrate fiber in an amount of 5%-150% using a milling roll or a slit, and then drying by a heating device and winding the substrate fiber around a fiber reel III.

The present application further provides a conductive far-infrared heat-generating fiber, comprising substrate fiber and coating layer of conductive material coated on the surface of the fiber.

Preferably, the substrate fiber is one or more selected from polypropylene fiber, polyethylene fiber, polyester fiber, polyamide fiber, polypropylene fiber, regenerated cellulose fiber, polyurethane fiber, polyvinyl alcohol fiber, polyvinyl chloride fiber, poly-p-phenylene terephthamide fiber, polyimide fiber and aramid fiber, and the substrate fiber has a fineness of 5 deniers-5,000 deniers; and the conductive material in the coating layer of conductive material is one or more selected from graphite, conductive carbon black, silver, copper, carbon nanotube, nickel, graphene, gold and aluminum, and the conductive material is in an amount of 0.1 wt %-100 wt % based on the fiber.

The present application provides a method for preparing a conductive far-infrared heat-generating fiber, comprising pretreating a substrate fiber to remove impurities in the surface of the substrate fiber, and then impregnating the pretreated substrate fiber into a coating liquid of a conductive material to allow the coating liquid of the conductive material to form coating layer of conductive material at the surface of the substrate fiber, so that the fiber has conductive properties. The above preparation method is simple, and by adopting the above method, good control of conductivity and heat generation of the conductive far-infrared heat-generating fiber is realized. The experiment results show that the electrical resistance of the conductive far-infrared heat-generating fiber can reach 10 $ohms \cdot m^{-1}$ to 2,000,000 $ohms \cdot m^{-1}$; and when the conductive far-infrared heat-generating fiber is woven into a fabric, the fabric would emit far infrared rays having an emission wavelength of 5 microns to 14 microns and generate heat when the two ends of the fabric were applied a voltage of 3 volts to 36 volts, in which the emission rate of the far infrared rays ranged from 0.8 to 0.95, and the temperature increased by 1.4° C. to 30° C.

DETAILED DESCRIPTION

For further understanding of the present disclosure, preferred embodiments of the present disclosure are described below in conjunction with examples. However, it should be understood that these descriptions are only for further illustrating the features and advantages of the present disclosure, rather than limiting the claims of the present disclosure.

In view of the problems that the conductive fiber provided in the prior art has a long preparation process flow and the electrical resistance and heat generation of the conductive fiber is difficult to control, the present application provides a method for preparing conductive far-infrared heat-generating fiber materials. This method has a short process flow, and it can achieve good control of electrical resistance and heat generation of the conductive fiber. In particular, the method for preparing conductive far-infrared heat-generating fiber materials in the present disclosure comprises specifically the following steps:

A) pretreating a substrate fiber in a pretreatment liquid, and then drying; and

B) impregnating the substrate fiber obtained in step A) into a coating liquid of a conductive material, and then drying, wherein step B) is carried out at least once, to obtain the conductive far-infrared heat-generating fiber.

In the process of preparing the conductive far-infrared heat-generating fiber in the present application, firstly the raw material is prepared, that is, the coating liquid of the conductive material is prepared. In respect of the coating liquid of the conductive material, the conductive material is in an amount of 0.01 wt %-85 wt %. In a specific embodiment, the conductive material is in an amount of 1 wt %-80 wt %. More specifically, the conductive material is in an amount of 5 wt %-50 wt %. The conductive material is one or more selected from graphite, conductive carbon black, silver, copper, carbon nanotube, nickel, graphene, gold and aluminum, and the conductive material has a size of 1 nm to 10 m. The coating liquid of the conductive material may further comprise 0.1 wt %-50 wt % of additive, wherein the additive is resin and curing agent, wherein the resin is one or more selected from epoxy resin, organic silicone resin, polyimide resin, phenolic resin, polyurethane resin, acrylic resin and unsaturated polyester resin, and the curing agent is one or more selected from curing agents of aliphatic amines, aromatic amines, amidoamines, latent curing amines, urea, polythiols and polyisocyanates.

After the preparation of the raw materials is completed, the pretreatment of the substrate fiber is carried out. In accordance with the present disclosure, the pretreatment may be performed by pretreating the substrate fiber in a pretreatment liquid, or by pretreating the substrate fiber using plasma, or by both the above two pretreatment methods, with no order in this case. The pretreatment liquid is an aqueous pretreatment liquid or an oily pretreatment liquid, that is, the pretreatment liquid uses water or an organic solvent as a solvent, and the pretreatment liquid comprises 0.01 wt % to 30 wt % of surfactant or oxidant. In a specific embodiment, the pretreatment liquid comprises 0.5 wt % to 28 wt % of surfactant or oxidant. Specifically, the surfactant is one or more selected from anionic surfactant, cationic surfactant, nonionic surfactant and Gemini surfactant, wherein the anionic surfactant is one or more selected from sulfate, fatty acid salts, anion polyacrylamide, sulfonate and phosphate surfactants; and the nonionic surfactant is one or more selected from polyethylene oxide and polylol surfactants; and the cationic surfactant is one or more selected from amine salts, quaternary ammonium salts, and heterocycles surfactants; and the Gemini surfactants are one or more selected from symmetric and asymmetric Gemini surfactants. The oxidant is one or more selected from organic oxidant and inorganic oxidant. More specifically, the inorganic oxidant is one or more selected from hydrogen peroxide, sodium percarbonate, sodium peroxydisulfate, potassium peroxydisulfate, sodium peroxide, potassium peroxide, calcium peroxide and barium peroxide; and the organic oxidant is one or more selected from peracetic acid, benzoyl peroxide, cyclohexanone peroxide, performic acid, tert-butyl hydroperoxide, dicumyl peroxide, tert-butyl peroxybenzoate and methyl ethyl ketone peroxide.

In accordance with the present disclosure, after the pretreatment liquid is prepared, the substrate fiber is pretreated by the pretreatment liquid, and then the fiber is dried. This process is specifically as follow:

placing the pretreatment liquid into a liquid tank, drawing out the substrate fiber from a fiber reel I, impregnating the substrate fiber across a guide eyelit into the pretreatment liquid using a guide roller, controlling the amount of the liquid applied on the substrate fiber using a milling roll or a slit, and then drying by a heating device and winding the substrate fiber around a fiber reel II.

In the above process, the drying temperature is 50° C. to 100° C., and the pretreatment may be performed for 1 to 5 times as needed to remove impurities on the surface of the substrate fiber.

Atmospheric pressure plasma or vacuum plasma is adopted as the plasma. Specifically, the substrate fiber is pretreated by atmospheric pressure plasma under a condition of 0.05 MPa to 0.5 MPa and 40 watts to 1,000 watts for 5 seconds to 600 seconds, or by vacuum plasma under a condition of 10 kHz to 20 kHz in frequency and 50 watts to 1,000 watts for 5 seconds to 600 seconds. The substrate fiber is treated by plasma surface modification for 1 time to 5 times. In the present application, the substrate fiber can be a fiber well known to these skilled in art. Specifically, the substrate fiber is one or more selected from polypropylene fiber, polyethylene fiber, polyester fiber, polyamide fiber, polypropylene fiber, regenerated cellulose fiber, polyurethane fiber, polyvinyl alcohol fiber, polyvinyl chloride fiber, tencel, poly-p-phenylene terephthamide fiber, polyimide fiber and aramid fiber; and in specific examples, the substrate fiber is one or three selected from polypropylene fiber filament, polyethylene fiber filament, polyester fiber filament, polyamide fiber filament, aramid filament, tencel, polyvinylchloride and polyimide fiber. The fiber has a fineness of 5 deniers to 5,000 deniers. In a specific embodiment, the fiber has a fineness of 50 deniers to 1,000 deniers.

In accordance with the present disclosure, the pretreated substrate fiber is then impregnated into a coating liquid of a conductive material, and then dried to obtain the conductive far-infrared heat-generating fiber. Specifically, the process of preparing the above conductive far-infrared heat-generating fiber is specifically as follow:

placing the coating liquid of the conductive material into a liquid tank, drawing out the substrate fiber wound around the fiber reel II, impregnating the substrate fiber across a guide eyelit into a coating liquid of a conductive material using a guide roller, controlling the liquid applied on the substrate fiber in an amount of 5%-150% using a milling roll, and then drying by a heating device and winding the substrate fiber around a fiber reel III.

The above process is a process in which the conductive material is coated on the surface of the fiber. The coating liquid of the conductive material forms a coating layer of the conductive material on the surface of the fiber in the above process, and the coating layer of the conductive material is wrapped on the surface of each fiber. The above process may be performed for several times as needed, specifically for 1 time to 9 times, and in specific embodiments for 2 times to 7 times. The drying temperature is 50-100° C.

Furthermore, after drying, the substrate fiber can be cured in a curing liquid. The curing liquid is that contains 0.1 wt % to 100 wt % of resin or curing agent or both. When the curing liquid contains both the resin and the curing agent, the mass ratio of the resin to the curing agent is from 1:0.01 to 1:1. The resin is one or more selected from epoxy resin, organic silicone resin, polyimide resin, phenolic resin, polyurethane resin, acrylic resin and unsaturated polyester resin, and the curing agent is one or more selected from curing agents of aliphatic amines, aromatic amines, amidoamines, latent curing amines, urea, polythiols and polyisocyanates. The curing temperature is 100-250° C., and the curing time is 30-3600 s. In accordance with the present disclosure, the process of repeating the operation may be repeating the steps of coating and curing the coating layer of the conductive material, or after coating the coating layer of the conductive material, repeating this step for multiple times and then curing. There are no special restrictions for this.

The present application also provides a conductive far-infrared heat-generating fiber prepared by the method described above, which is composed of fiber and coating layer of conductive material coated on the surface of the fiber. The fiber and the conductive material in the coating layer of the conductive material has been described in detail, and will not be repeated here. In the conductive far-infrared heat-generating fiber, the conductive material is in an amount of 0.1% to 100% based on the fiber. In a specific embodiment, the conductive material is in an amount of 0.5% to 60% based on the fiber. The amount of the conductive material has a large impact on the electrical resistance of the conductive far-infrared heat-generating fiber.

The composite conductive material provided in the present application uses fiber as the substrate and the conductive material as the coating layer. At the same time, its preparation method is simple, and through the amount and composition of the conductive material, good control of the electrical resistance of the conductive far-infrared heat-generating fiber is effectively realized. The experiment results show that the electrical resistance of the conductive far-infrared heat-generating fiber can reach 10 $ohms \cdot m^{-1}$ to 2,000,000 $ohms \cdot m^{-1}$; and when the conductive far-infrared heat-generating fiber is woven into a fabric, the fabric would emit far infrared rays having an emission wavelength of 5 microns to 14 microns and generate heat when the two ends of the fabric were applied a voltage of 3 volts to 36 volts, in which the emission rate of the far infrared rays ranged from 0.8 to 0.95, and the temperature increased by 1.4° C. to 30° C.

In order to further understand the present disclosure, the conductive far-infrared heat-generating fiber provided in the present disclosure will be described in more detail below in conjunction with examples, but it should to be noted that the protection scope of the present disclosure is not limited by the following examples.

Example 1

(1) An aqueous solution containing 0.01% by mass of sodium dodecyl sulfate was prepared as a pretreatment liquid for a substrate fiber of a polypropylene fiber filament;

(2) The pretreatment liquid was poured into a liquid tank, and the polypropylene fiber filament having a fineness of 50 deniers was drawn out from a fiber reel I, and then the polypropylene fiber filament was impregnated across a guide eyelit into the pretreatment liquid using a guide roller to impregnate the pretreatment liquid, the amount of the liquid applied on the polypropylene fiber filament was controlled at 90% by a slit, and then the fiber filament was dried at 50° C. by a heating device and wound around a fiber reel II, so as to remove the impurities on the surface of the polypropylene fiber filament;

(3) An aqueous coating liquid of a conductive graphite paste was prepared, in which the conductive graphite paste was in an amount of 0.01% by mass, and the average size of the particle in the conductive graphite paste was 5 microns;

(4) The coating liquid of the conductive graphite paste was poured into a liquid tank, and the polypropylene fiber filament wound around the fiber reel II was drawn out, and then the polypropylene fiber filament was impregnated across a guide eyelit into the coating liquid using a guide roller to impregnate the coating liquid, the amount of the liquid applied on the polypropylene fiber filament was controlled at 5% by a milling roll, and then the fiber filament was dried at 50° C. by a heating device and wound around a fiber reel III, and the fiber filament was further impregnated with 0.1% by mass of a curing liquid of a diphenol propane epoxy resin and then cured at 100° C. for 3,600 seconds, to produce a conductive far-infrared heat-generating fiber.

The above conductive far-infrared heat-generating fiber used polypropylene fiber filament having a fineness of 50 deniers as the substrate fiber, and used graphite as the outer conductive material. The graphite conductive material was in an amount of 0.1% based on the mass of the substrate fiber. The measured electrical resistance of the conductive far-infrared heat-generating fiber was 2,000,000 ohms·m$^{-1}$. When the conductive far-infrared heat-generating fiber was woven into a fabric, the fabric emitted far infrared rays having an wavelength of 5 microns to 14 microns when the two ends of the fabric were applied a voltage of 36 volts, in which the emission rate of the far infrared rays was 0.95, and the temperature increased by 1.4° C.

Example 2

(1) An aqueous solution containing 1% by mass of span-80 was prepared as a pretreatment liquid for a substrate fiber of polyethylene fiber filament;

(2) The pretreatment liquid was poured into a liquid tank, and the polyethylene fiber filament having a fineness of 70 deniers was drawn out from a fiber reel I, and then the polyethylene fiber filament was impregnated across a guide eyelit into the pretreatment liquid using a guide roller to impregnate the pretreatment liquid, the amount of the liquid applied on the polyethylene fiber filament was controlled at 90% by a slit, and then the fiber filament was dried at 80° C. by a heating device and wound around a fiber reel II, so as to remove impurities on the surface of the polyethylene fiber filament;

(3) An aqueous coating liquid of a conductive carbon black paste was prepared, in which the conductive carbon black paste was in an amount of 1% by mass, and the average size of the particle in the conductive carbon black paste was 3 microns;

(4) The coating liquid of the conductive carbon black paste was poured into a liquid tank, and the polyethylene fiber filament wound around the fiber reel II was drawn out, and then the polyethylene fiber filament was impregnated across a guide eyelit into the coating liquid using a guide roller to impregnate the coating liquid, the amount of the liquid applied on the polyethylene fiber filament was controlled at 15% by a milling roll, and then the fiber filament was dried at 80° C. by a heating device and wound around a fiber reel III. The above process was repeated for 5 times. The fiber filament was further impregnated with 10% by mass of a mixed liquid of epoxy bisphenol A resin and a latent curing agent HF-3412 from INV, Germany, in a ratio of 1:0.1, and then cured at 80° C. for 1800 seconds, to produce a conductive far-infrared heat-generating fiber.

The above conductive far-infrared heat-generating fiber used polyethylene fiber filament having a fineness of 70 deniers as the substrate fiber, and used conductive carbon black as the outer conductive material. The conductive material was in an amount of 0.5% based on the mass of the substrate fiber. The measured electrical resistance of the conductive far-infrared heat-generating fiber was 1,900,000 ohms·m$^{-1}$. When the conductive far-infrared heat-generating fiber was woven into a fabric, the fabric emitted far infrared rays having an wavelength of 5 microns to 14 microns when the two ends of the fabric were applied a voltage of 3 volts, in which the emission rate of the far infrared rays was 0.88, and the temperature increased by 1.5° C.

Example 3

(1) An aqueous solution containing 28% by mass of dodecyl trimethyl ammonium chloride was prepared as a pretreatment liquid for a substrate fiber of polyester fiber filament;

(2) The pretreatment liquid was poured into a liquid tank, and the polyester fiber filament having a fineness of 100 deniers was drawn out from a fiber reel I, and then the polyester fiber filament was impregnated across a guide eyelit into the pretreatment liquid using a guide roller to impregnate the pretreatment liquid, the amount of the liquid applied on the polyester fiber filament was controlled at 90% by a slit, and then the fiber filament was dried at 80° C. by a heating device and wound around a fiber reel II, so as to remove impurities on the surface of the polyester fiber filament;

(3) An oily coating liquid of a conductive silver paste was prepared, in which the conductive silver paste was in an amount of 5% by mass, and the average size of the particle in the conductive silver paste was 3 microns;

(4) The coating liquid of the conductive silver paste was poured into a liquid tank, and the polyethylene fiber filament wound around the fiber reel II was drawn out, and then the polyethylene fiber filament was impregnated across a guide eyelit into the coating liquid using a guide roller to impregnate the coating liquid, the amount of the liquid applied on the polyethylene fiber filament was controlled at 3% by a milling roll, and then the fiber filament was dried at 80° C. by a heating device and wound around a fiber reel III, and the fiber filament was further impregnated with 5% by mass of a curing liquid of latent curing agent HF-3412 from INV, Germany, and then cured at 80° C. for 1800 seconds, to produce a conductive far-infrared heat-generating fiber.

The above conductive far-infrared heat-generating fiber used polyester fiber filament having a fineness of 100 deniers as the substrate fiber, and used silver as the outer conductive material. The conductive material was in an amount of 21% based on the mass of the substrate fiber. The measured electrical resistance of the conductive far-infrared heat-generating fiber was 10 ohms·m$^{-1}$. When the conductive far-infrared heat-generating fiber was woven into a fabric, the fabric emitted far infrared rays having an wavelength of 5 microns to 14 microns when the two ends of the fabric were applied a voltage of 3 volts, in which the emission rate of the far infrared rays was 0.8, and the temperature increased by 3.4° C.

Example 4

(1) An aqueous solution containing 0.5% by mass of diethyl maleate bis(hexadecyldimethyl ammonium bromide) was prepared as a pretreatment liquid for a substrate fiber of polyamide fiber filament.
(2) The pretreatment liquid was poured into a liquid tank, and the polyamide fiber filament having a fineness of 78 deniers was drawn out from a fiber reel I, and then the polyamide fiber filament was impregnated across a guide eyelit into the pretreatment liquid using a guide roller to impregnate with the pretreatment liquid, the amount of the liquid applied on the polyamide fiber filament was controlled at 90% by a milling roll, and then the fiber filament was dried at 80° C. by a heating device and wound around a fiber reel II, so as to remove impurities on the surface of the polyamide fiber filament;
(3) An oily coating liquid of a conductive graphene paste was prepared, in which the conductive graphene paste was in an amount of 30% by mass, and the average size of the particle in the conductive graphene paste was 500 nanometers;
(4) The coating liquid of the conductive graphene paste was poured into a liquid tank, and the polyamide fiber filament wound around the fiber reel II was drawn out, and then the polyamide fiber filament was impregnated across a guide eyelit into the coating liquid using a guide roller to impregnate the coating liquid, the amount of the liquid applied on the polyamide fiber filament was controlled at 15% by a milling roll, and then the fiber filament was dried at 80° C. by a heating device and wound around a fiber reel III. The above process was repeated for 7 times, to produce a conductive far-infrared heat-generating fiber.

The above conductive far-infrared heat-generating fiber used polyamide fiber filament having a fineness of 78 deniers as the substrate fiber, and used graphene as the outer conductive material. The conductive material was in an amount of 50% based on the mass of the substrate fiber. The measured electrical resistance of the conductive far-infrared heat-generating fiber was 35,000 ohms·m$^{-1}$. When the conductive far-infrared heat-generating fiber was woven into a fabric, the fabric emitted far infrared rays having an wavelength of 5 microns to 14 microns when the two ends of the fabric were applied a voltage of 5 volts, in which the emission rate of the far infrared rays was 0.89, and the temperature increased by 12° C.

Example 5

(1) An aqueous solution containing 0.5% by mass of diethyl maleate bis(hexadecyldimethyl ammonium bromide) was prepared as a pretreatment liquid for a substrate fiber of aramid filament.
(2) The pretreatment liquid was poured into a liquid tank, and the aramid filament with a fineness of 5,000 deniers was drawn out from a fiber reel I, and then the aramid filament was impregnated across a guide eyelit into the pretreatment liquid using a guide roller to impregnate the pretreatment liquid, the amount of the liquid applied on the aramid filament was controlled at 90% by a milling roll, and then the fiber filament was dried at 80° C. by a heating device and wound around a fiber reel II, so as to remove impurities on the surface of the aramid filament; and the fiber filament was further treated by atmospheric pressure plasma under a condition of 0.1 MPa and 1,000 watts for 600 seconds, to treat the substrate fiber of the aramid filament by plasma surface modification for 4 times;
(3) An aqueous coating liquid of a conductive carbon nanotube paste was prepared, in which the conductive carbon nanotube paste was in an amount of 80% by mass, and the average size of the particle in the conductive carbon nanotube paste was 50 nanometers;
(4) The coating liquid of the conductive carbon nanotube paste was poured into a liquid tank, and the aramid filament wound around the fiber reel II was drawn out, and then the aramid filament was impregnated across a guide eyelit into the pretreatment liquid using a guide roller to impregnate with the coating liquid, the amount of the liquid applied on the aramid filament was controlled at 15% by a milling roll, and then the fiber filament was dried at 80° C. by a heating device and wound around a fiber reel III. The above process was repeated for 3 times, to produce a conductive far-infrared heat-generating fiber.

The above conductive far-infrared heat-generating fiber used aramid filament having a fineness of 5,000 deniers as the substrate fiber, and used carbon nanotube as the outer conductive material. The conductive material was in an amount of 100% based on the mass of the substrate fiber. The measured electrical resistance of the conductive far-infrared heat-generating fiber was 9,000 ohms·m$^{-1}$. When the conductive far-infrared heat-generating fiber was woven into a fabric, the fabric emitted far infrared rays having an wavelength of 5 microns to 14 microns when the two ends of the fabric were applied a voltage of 24 volts, in which the emission rate of the far infrared rays was 0.95, and the temperature increased by 30° C.

Example 6

(1) An aqueous solution containing 0.5% by mass of sodium persulfate was prepared as a pretreatment liquid for a substrate fiber of a blended yarn of polyester fiber, polyvinyl chloride fiber and tencel;
(2) The pretreatment liquid was poured into a liquid tank, and the blended yarn of polyester fiber, polyvinyl chloride fiber and tencel with a fineness of 150 deniers was drawn out from a fiber reel I, and then the blended yarn of polyester fiber, polyvinyl chloride fiber and tencel was impregnated across a guide eyelit into the pretreatment liquid using a guide roller to impregnate the pretreatment liquid, the amount of the liquid applied on the yarn was controlled at 90% by a milling roll, and then the yarn was dried at 80° C. by a heating device and wound around a fiber reel II, so as to remove impurities on the surface of the blended yarn of polyester fiber, polyvinyl chloride fiber and tencel;
(3) An oily coating liquid of a mixed paste including a conductive graphene paste and a conductive aluminum paste was prepared, in which the ratio of the conductive graphene paste to the conductive aluminum paste was 5:1, and the mixed paste was in an amount of 30% by mass, and the average size of the particle in the mixed paste was 500 nanometers;

(4) The coating liquid of the mixed paste was poured into a liquid tank, and the blended yarn of polyester fiber, polyvinyl chloride fiber and tencel wound around the fiber reel II was drawn out, and then the yarn was impregnated across a guide eyelit into the pretreatment liquid using a guide roller to impregnate the coating liquid, the amount of the liquid applied on the yarn was controlled at 15% by a slit, and then the yarn was dried at 80° C. by a heating device and wound around a fiber reel III, to produce a conductive far-infrared heat-generating fiber.

The above conductive far-infrared heat-generating fiber used blended yarn of polyester fiber, polyvinyl chloride fiber and tencel having a fineness of 150 deniers as the substrate fiber, and used the graphene and the aluminum as the outer conductive material. The conductive material was in an amount of 60% based on the mass of the substrate fiber. The measured electrical resistance of the conductive far-infrared heat-generating fiber was 15,000 ohms·$m^{-1}$. When the conductive far-infrared heat-generating fiber was woven into a fabric, the fabric emitted far infrared rays having an wavelength of 5 microns to 14 microns when the two ends of the fabric were applied a voltage of 24 volts, in which the emission rate of the far infrared rays was 0.95, and the temperature increased by 5° C.

Example 7

(1) An aqueous solution containing 1% by mass of peracetic acid was prepared as a pretreatment liquid for a substrate fiber of a polyimide fiber filament;

(2) The pretreatment liquid was poured into a liquid tank, and the polyimide fiber filament having a fineness of 650 deniers was drawn out from a fiber reel I, and then the polyimide fiber filament was impregnated across a guide eyelit into the pretreatment liquid using a guide roller to impregnate with the pretreatment liquid, the amount of the liquid applied on the polyimide fiber filament was controlled at 90% by a milling roll, and then the fiber filament was dried at 80° C. by a heating apparatus and wound around a fiber reel II, so as to remove impurities from the surface of the polyimide fiber filament;

(3) An oily coating liquid of a mixed paste including a conductive carbon nanotube paste and a conductive carbon black paste was prepared. The ratio of the conductive carbon nanotube paste to the conductive carbon black paste was 2:1 and the mixed paste was in an amount of 50% by mass, and the average size of the particle in the mixed paste was 800 nanometers;

(4) The coating liquid of the mixed paste was poured into a liquid tank, and the polyimide fiber filament wound around the fiber reel II was drawn out, and then the polyimide fiber filament was impregnated across a guide eyelit into the pretreatment liquid using a guide roller to impregnate with the coating liquid, the amount of the liquid applied on the polyimide fiber filament was controlled at 40% by a milling roll, and then the fiber filament was dried at 80° C. by a heating device and wound around a fiber reel III. The above process was repeated for 2 times, to produce a conductive far-infrared heat-generating fiber.

The above conductive far-infrared heat-generating fiber used polyimide fiber filament having a fineness of 650 deniers as the substrate fiber, and used carbon nanotube and conductive carbon black as the outer conductive material. The conductive material was in an amount of 60% based on the mass of the substrate fiber. The measured electrical resistance of the conductive far-infrared heat-generating fiber was 11,000 ohms·$m^{-1}$. When the conductive far-infrared heat-generating fiber was woven into a fabric, the fabric emitted far infrared rays having an wavelength of 5 microns to 14 microns when the two ends of the fabric were applied a voltage of 24 volts, in which the emission rate of the far infrared rays was 0.95, and the temperature increased by 23° C.

The above description of the examples is only used to facilitate understanding of the method and core concept of the present disclosure. It should be noted that for those skilled in the art, various improvements and modifications may be made without departing from the principle of the present disclosure, and these improvements and modifications should fall within the scope of protection of the present disclosure.

Based on the above description of the disclosed examples, those skilled in the art can implement or carry out the present disclosure. It is apparent for those skilled in the art to make many modifications to these examples. The general principle defined herein may be applied to other examples without departing from the spirit or scope of the present disclosure. Therefore, the present disclosure is not limited to the examples illustrated herein, but should conform to the widest scope consistent with the principle and novel features disclosed herein.

The invention claimed is:

1. A method for preparing a conductive far-infrared heat-generating fiber, comprising the following steps:

A) pretreating a substrate fiber, and then drying, wherein step A) is specifically performed by:

placing a pretreatment liquid into a liquid tank, drawing out the substrate fiber from a fiber reel I, impregnating the substrate fiber across a guide eyelit into the pretreatment liquid using a guide roller, controlling the amount of the liquid applied on the substrate fiber using a milling roll or a slit, and then drying by a heating device and winding the substrate fiber around a fiber reel II, wherein the pretreatment liquid comprises 0.01 wt %-30 wt % of surfactant or oxidant in water or an organic solvent; wherein the surfactant is at least one of anionic surfactant, cationic surfactant and Gemini surfactant; and the oxidant is at least one of organic oxidant and inorganic oxidant; and B) impregnating the substrate fiber obtained in step A) into a liquid of a conductive material, and then drying, wherein step B) is specifically performed by:

placing the liquid of the conductive material into a liquid tank, drawing out the substrate fiber wound around the fiber reel II, impregnating the substrate fiber across a guide eyelit into the liquid of a conductive material using a guide roller, controlling the liquid applied on the substrate fiber in an amount of 5 wt %-150 wt % based on untreated substrate fiber using a milling roll or a slit, and then drying by a heating device and winding the substrate fiber around a fiber reel III;

wherein step B) is carried out at least once, to obtain a conductive far-infrared heat-generating fiber;

wherein the method further comprises curing the dried fiber after drying in step B), or when step B) is carried out more than once, the method further comprises curing after step B) is repeated, wherein the curing temperature is 100-250° C., and the curing time is 30-3600 s;

wherein the liquid of the conductive material is at least one of conductive carbon black paste, conductive graphene paste, conductive carbon nanotube paste, and conductive graphite paste;

wherein the conductive material in the liquid of conductive material is at least one of graphite, conductive carbon black, carbon nanotube, and graphene;

wherein the liquid of the conductive material further comprises 0.1 wt %-50 wt % of additive, wherein the additive is resin and curing agent, wherein the resin is at least one of epoxy resin, organic silicone resin, polyimide resin, phenolic resin, polyurethane resin, acrylic resin and unsaturated polyester resin, and the curing agent is at least one of aliphatic amines, aromatic amines, amidoamines, latent curing amines, urea, polythiols and polyisocyanates;

wherein the electrical resistance of the conductive far-infrared heat-generating fiber reaches 10 $ohms \cdot m^{-1}$ to 2,000,000 $ohms \cdot m^{-1}$; and when the conductive far-infrared heat-generating fiber is woven into a fabric, the fabric would emit far infrared rays having an emission wavelength of 5 microns to 14 microns and generate heat when the two ends of the fabric were applied a voltage of 3 volts to 36 volts, in which the emission rate of the far infrared rays ranged from 0.8 to 0.95, and the temperature increased by 1.4° C. to 30° C.

* * * * *